United States Patent [19]

Verhille et al.

[11] 4,171,224

[45] Oct. 16, 1979

[54] METHOD AND APPARATUS SUITABLE FOR THE PREPARATION OF AGX-EMULSIONS

[75] Inventors: Karel E. Verhille, Hoboken; Paul V. Biermans, Borsbeek; Roland Van Keilegom, Mortsel, all of Belgium

[73] Assignee: AGFA-GEVAERT N.V., Mortsel, Belgium

[21] Appl. No.: 832,645

[22] Filed: Sep. 12, 1977

[30] Foreign Application Priority Data

Sep. 14, 1976 [GB] United Kingdom ..... 38022/76

[51] Int. Cl.[2] ..... G03C 1/02

[52] U.S. Cl. ..... 96/94 R; 366/131

[58] Field of Search ..... 96/94 R; 366/131

[56] References Cited

U.S. PATENT DOCUMENTS

| | | | |
|---|---|---|---|
| 3,628,959 | 12/1971 | Theilemann | 96/94 R |
| 3,705,034 | 12/1972 | McNamara | 96/94 R |
| 3,782,954 | 1/1974 | Porter et al. | 96/94 R |
| 3,790,386 | 2/1974 | Posse et al. | 96/94 R |
| 3,801,326 | 4/1974 | Claes | 96/94 R |

*Primary Examiner*—Travis Brown
*Attorney, Agent, or Firm*—William J. Daniel

[57] ABSTRACT

A photosensitive silver halide emulsion is prepared by circulating separate streams of circulating peptizer solution with at least one power operated pump through separate mixing zones in which one stream is mixed with a solution of a silver salt and the other is mixed with a solution a halide salt, and these streams are then combined and mixed in a reaction zone so that silver halide crystals are formed by reaction between silver salt and halide salt and the circulating peptizer solution contains increasing amounts of silver halide crystals in course of time, such circulation being continued until a silver halide emulsion of a predetermined concentration has been formed. Each of the separate streams of peptizer solution is forced through its respective separate mixing zone and into the reaction zone from the nozzle of a venturi-type pump and a stream of the silver salt solution and/or the halide salt solution as the case may be is caused to feed into the respective separate mixing zone under the influence of and at a flow rate dependent on the venturi suction effect of the corresponding venturi-type pump, the venturi pumps being operated under such conditions as to damp high frequency (above 1 Hz) pAg oscillations attributable to the inherent characteristics of the pump.

11 Claims, 6 Drawing Figures

METHOD AND APPARATUS SUITABLE FOR THE PREPARATION OF AGX-EMULSIONS

This invention relates to a method and apparatus for the preparation of photosensitive silver halide emulsions.

It is well known that the properties of silver halide dispersions (so-called emulsions) are strongly influenced by the environmental conditions in which the silver halide grains are formed. The influential parameters are numerous. They include the mixing rates of solutions of reactive silver and halide salts, the relative amounts of the reactants in the reaction mixture, the pAg, the pH and the temperature of such mixture and the mechanical forces to which the mixture is subjected.

In the art of silver halide emulsion preparation numerous measures are known for influencing emulsion properties and in particular for improving the uniformity of the emulsion and the reproducability of results under industrial manufacturing conditions. These known measures include automatic control of the flow rates of the reactant solutions to a reaction zone.

It is known to prepare silver halide emulsions batchwise by introducing silver salt and halide salt solutions into a circulating volume of peptizer solution which is repeatedly recycled. This procedure has the advantage over continuous preparation systems that smaller amounts of peptizer can be used. The recycling of peptizer solution and the addition of reactants thereto can continue until a silver halide emulsion with a predetermined concentration of silver halide is attained.

The problems of producing uniform emulsions in a reproducable way arise when employing such a recycling technique as well as in the continuous systems. In order to achieve better control of the flow rates and the mixing of the reactants, and thereby to achieve a narrow grain size distribution of the silver halide grains, it has been proposed to dilute the different reactants with separate parts of the circulating peptizer solution, such parts being relatively small in volume in relation to the bulk volume of the peptizer, and then to combine these parts to bring about precipitation of the silver halide crystals.

When proceeding according to this prior proposal unpredictable variations in the reaction conditions have been found to occur. In particular undesirable variations in the relative flow rates of the reactants to the reaction zone tend to occur notwithstanding the employment of a flow control device for controlling the rates at which the reactants are pumped to the reaction zone.

The subject of the present invention is a method with novel characteristics which promise to make it easier to consistently obtain predetermined emulsion properties.

According to the present invention a method is provided for the preparation of a photosensitive silver halide emulsion wherein separate streams of circulating peptizer solution, circulated with a power operated pump or pumps, are passed through separate mixing zones in which one is mixed with a solution of a silver salt and the other is mixed with a solution of a halide salt, and these streams are then combined and mixed in a reaction zone so that silver halide crystals are formed by reaction between silver salt and halide salt and the circulating peptizer solution contains increasing amounts of silver halide crystals in course of time, such circulation being continued until a silver halide emulsion of a predetermined concentration has been formed, characterised in that each of these separate streams of peptizer solution is forced through its respective separate mixing zones and into the reaction zone from the nozzle of a venturi-type pump and streams of each the silver salt solution and the halide salt solution fed into the corresponding separate mixing zone under the influence of and at a flow rate dependent on the venturi suction effect of the corresponding venturi-type pump, said venturi pumps being operated under such conditions as to damp high frequency (above 1 Hz) pAg oscillations attributable to the inherent characteristics of the pump or pumps used for circulating the emulsion. For obtaining particularly efficient damping conditions, the venturi pumps are operated within their stable operating range as herein defined.

Experiments show that by adopting a method according to the invention as above defined, variations in reaction conditions due to variations in the relative proportions in which the reactants are combined can be reduced or avoided.

The performance of a method according to the invention is particularly valuable when silver halide precipitation is to be carried out near the equivalence point to keep the mean silver halide grain size as small as possible.

The improvement resulting from the present invention is due to the suppression or reduction of "pAg-noise", i.e., high frequency oscillations of the pAg around the desired value. In any recycling system it is necessary to employ a power-operated pump in the peptizer circuit and our experiments show that the unpredictable variations in emulsion quality which have occurred when using the previously known preparation methods are probably due to the action of such pump. These variations tend to be particularly pronounced when employing a centrifugal pump. When using a method according to the invention the venturi pumps have a damping effect rendering variations in the pressure at the output side of the pump harmless or less harmful. Generally speaking, venturi pumps have a particularly advantageous influence on the suppression of "pAg noise" at frequencies higher than 1 Hz. Lower frequency pAg fluctuations can be avoided or suppressed by other means, e.g. flow control devices responsive to signals from pAg measuring instruments.

It is essential that the venturi pumps be operated within their stable operating range. The operating characteristics of a venturi pump can be represented graphically by plotting the operating pressure, i.e., the pressure before the nozzle, against the volume of liquid which is drawn into the pump per unit time by the venturi suction effect. Above a certain operating pressure and a certain volume flow rate of liquid through the suction passage, this volume flow rate is substantially independent of variations in operating pressure. This appears from FIG. 1 of the accompanying drawings which is a performance graph of one particular venturi pump. The operating pressure P (in psi) is represented on the ordinate and the flow volume/minute Q through the suction passage is represented on the abscissa. Above operating pressure P' the value of Q remains substantially constant with variations in P. The expression "stable operating range" where used herein in relation to a venturi pump denotes that range wherein Q is constant, within a tolerance smaller than 0.1% with variation in P. The performance curves for different pumps of different designs may occupy different positions on a graph with given ordinate and abscissa scales but the existence of a stable operating range at some point is a characteristic of all such curves.

In carrying out the invention it is not essential for the flow rates of the salt solutions through the suction passages of the venturi pumps to be solely dependent on the venturi suction forces. The important factor is that variations in those forces are accompanied by proportional variations in the flow rates of the reactants, assuming other conditions remain unchanged.

It is well known to control the volume mixing ratio of a silver salt solution and a halide salt solution in dependence on variations in the pAg of the resulting silver halide emulsion and in carrying out the present invention it is desirable in accordance with known practice to use pAg fluctuations as a control parameter. Accordingly in certain embodiments of the invention the flow rate of either salt solution or of each salt solution into the respective venturi pump may be made dependent in part on the venturi suction effect and in part on the action of a flow control device such as a flow control valve responsive to signals from a pAg measuring instrument as hereinbefore referred to. The pAg measuring instrument is preferably located for measuring the pAg of the silver halide at or near the outlet of the reaction zone. The pH of the emulsion is preferably also monitored. Means for sensing the pAg and the pH of the emulsion and yielding an electrical signal capable of exercising a flow control function are known per se in the art.

In preferred embodiments of the invention each of the streams of silver salt solution and halide salt solution, before entering the respective separate mixing zone, is prediluted with a secondary stream of circulating peptizer solution which also flows under the influence of and at a rate dependent on the venturi suction effect. By adopting this feature, the damping of undesired fluctuations in reaction conditions can be further promoted and the stable operating range of the venturi pumps can be achieved with relatively low volume flow rates of the dissolved reactants.

Preferably the volume mixing ratio between each salt solution stream and the corresponding secondary stream of peptizer solution is in the range 1:1 to 1:100.

The volume mixing ratio between the peptizer stream discharging from each venturi nozzle and the solution drawn into the venturi pump under the influence of the venturi suction effect is preferably in the range 2:1 to 1000:1 and most preferably in the range 20:1 to 40:1, the optimum ratio being about 30:1.

The circulating peptizer solution is preferably maintained in circulation by one or more centrifugal pumps. Such a pump is preferably installed with its output side connected by conduits to the nozzles of the venturi pumps. A further centrifugal pump can be located between the outlet of the reaction zone and an accumulating vessel from which recirculation of emulsion streams to the venturi nozzles takes place.

The separate mixing zones and the reaction zone are preferably formed by continuous-flow mixing passageways in which mixing occurs under the kinetic energy of the liquid streams flowing therethrough. The employment of driven blades or other driven mixing elements is thereby avoided. An example of a continuous flow mixing passageway is one defined by narrowly spaced surfaces or by a tube and of such cross-sectional form that at the prevailing fluid inlet pressure the solution in the passageway is in turbulent flow. However it is possible to promote mixing by using a static mixer wherein the flow passage contains stationary baffles or guide vanes imparting twisting or other directional changes on the liquid.

In order to obtain silver halide crystals with high uniformity in morphology, grain size and photographic sensitivity, the reaction between silver salt and halide salt preferably proceeds near the equivalence point. Preferably the formation of the silver halide takes place within a pAg interval 3.0 above and 3.0 below the equivalence point.

The method according to the present invention can be used for preparing aqueous and non-aqueous silver halide emulsions. The term "peptizer solution" as used herein includes aqueous and non-aqueous solutions containing protective colloid. Preference is given to aqueous solutions containing gelatin as protective colloid.

In some methods according to the invention, each of the streams of silver salt solution and halide salt solution flows to the corresponding venturi pump via a flow control valve which is responsive to signals from a flow meter, e.g. a magnetic flow meter, which tend to keep the volume flow rate of such stream at a pre-set value. It is very satisfactory to use pneumatically operated flow control valves. Such valves preferably have an hysteresis (maximum procentual gate opening difference at same pneumatic pressure during opening and closing of the gate) of less than 0.3%.

The silver halide emulsion discharging from the reaction zone is preferably received in a vessel of larger capacity than the reaction zone. Such receiving vessel, from which streams of emulsion are recycled through the nozzles of the venturi pumps and which can be called a ripening vessel, preferably has a volume that is at least 10 times and more, preferably at least 100 times as large as the volume of the reaction zone.

The silver and halide salts used in a method according to the invention may be any salts suitable for the purpose. A very suitable silver salt is silver nitrate. Other suitable silver salts include silver salts of fatty acids.

The process according to the present invention can be employed in the preparation of all types of photographic emulsions e.g., neutral, acid, and ammonia-type emulsions and according to a pre-set program adapted to different modes of emulsification. In the method of the invention the formation of the dispersed silver halide crystals can occur in the presence of grain-size influencing compounds i.e. compounds promoting or restraining grain growth e.g. thiocyanates, organic thioether compounds of the type described in U.S. Pat. No. 3,574,628 of Evan T. Jones, issued Apr. 13, 1971 and in DT OS No. 2,614,862 filed Apr. 6, 1976 by Agfa-Gevaert AG and compounds of the type described in U.S. Pat. No. 3,661,592 of Herman Adelbert Philippaerts, Robert Joseph Pollet, Jozef Frans Willems and Frans Henri Claes, issued May 9, 1972 and U.S. Pat. No. 3,704,130 of Robert Joseph Pollet, Herman Adelbert Philippaerts, Jozef Frans Willems and Frans Henri Claes, issued Nov. 28, 1972. In the preparation of silver halide emulsions according to the present invention any other type of agent known in the art for use at the precipitation stage and/or ripening stage can be present. The emulsification time, temperature, pH and pAg can easily be modified or varied.

The method according to the present invention is especially suitable for use in the production of fine monodisperse silver halide emulsions. Such emulsions are of importance for example for the preparation of photographic plates or films to be used in high resolution work, e.g. microphotography, astrophotography, the recording of nucleophysical phenomena, the preparation of masks for use in the production of micro-electronic circuits, and for recording and reproducing holograms or radiation interference or diffraction patterns.

Provided the precipitation proceeds under normal temperature conditions and the process proceeds near the equivalence point of the silver halide formation, silver halide emulsions with an average particle size (x) well below 0.05 microns and with a grain size distribution corresponding with a "dispersion" (s) below 0.0075 can be prepared by methods embodying the invention. Herein $x=(\Sigma x_y/y)$ wherein y is the number of grains of the sample and $x_y$ the individual grain size encountered in the number y of grains $$S = \sqrt{\frac{\Sigma(x_y - \bar{x})^2}{y - 1}}$$

Various advantageous features for use in carrying out a method according to the present invention are summarised in the method claims appearing later in this specification.

The present invention also includes apparatus which is constructed or which is constructed and set up so that a silver halide emulsion can be prepared therein by a method according to the invention as hereinbefore defined.

The invention includes for example various apparatus features as defined in the apparatus claims at the end of this specification.

Certain embodiments of the invention, selected by way of example, will now be described with reference to FIGS. 2 to 6 of the accompanying diagrammatic drawings. In such figures.

Figure 1:
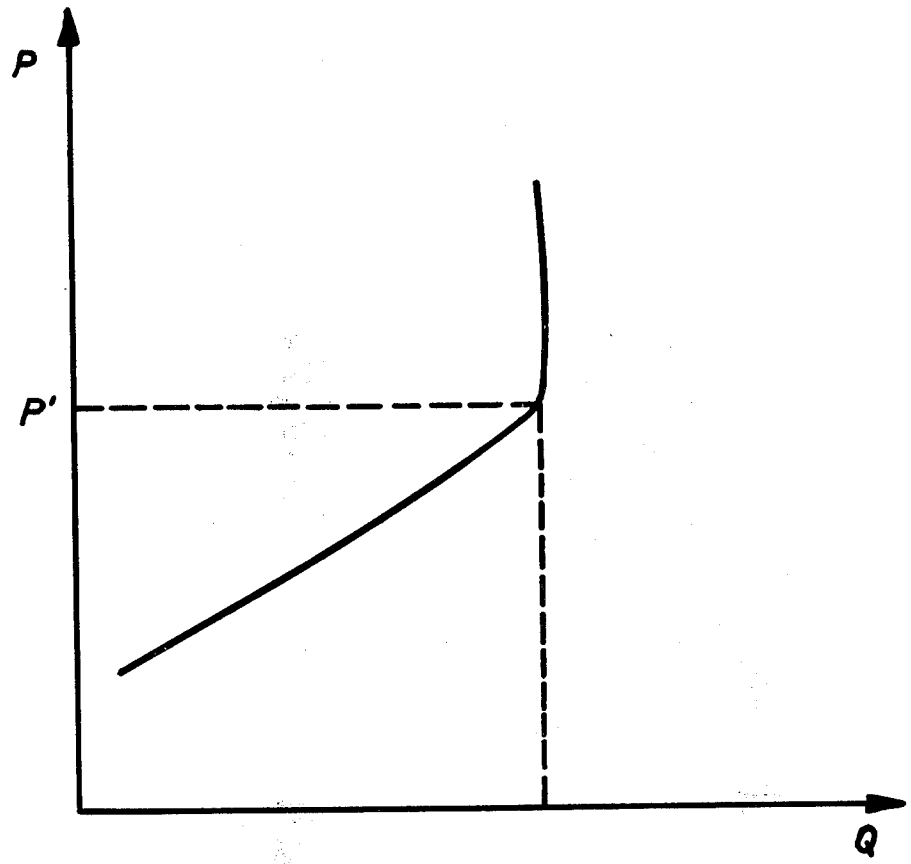
Figure 2:
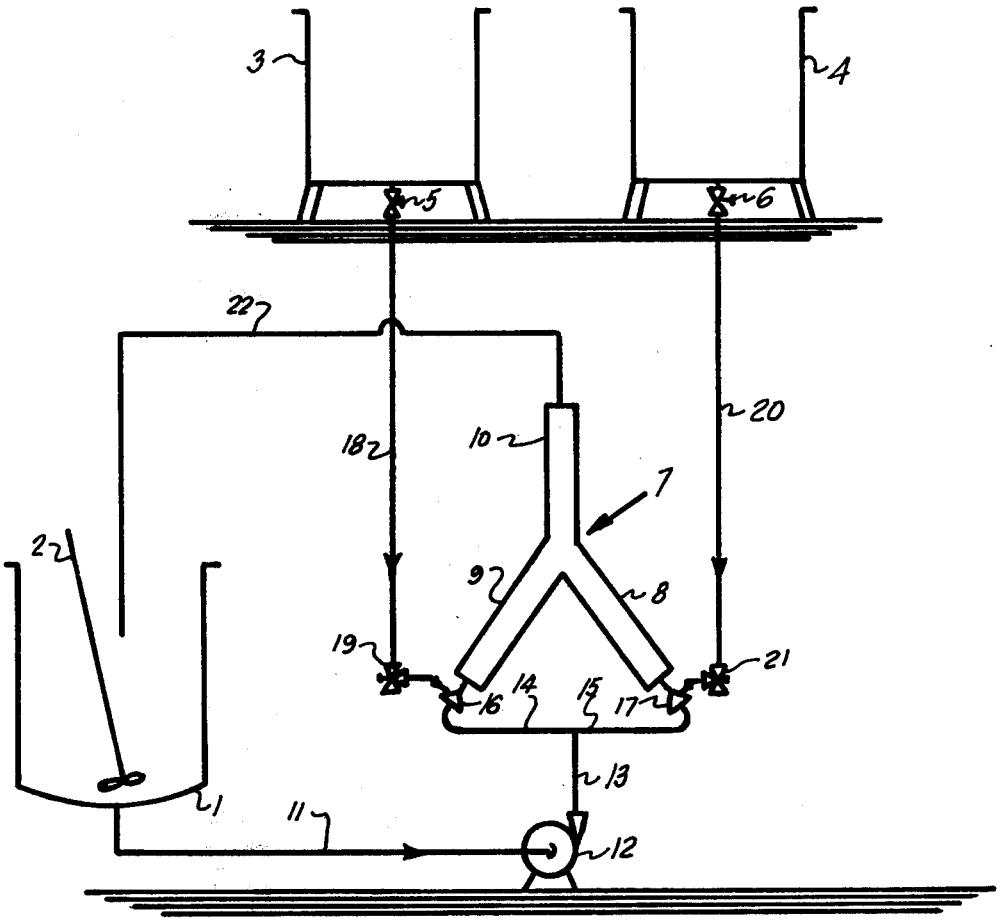
FIG. 2 represents an apparatus according to the invention for use in preparing silver halide emulsion by a preferred method according to the invention.

The apparatus shown in FIG. 2 incorporates a receiving vessel 1 in which a peptizer solution essentially composed of water and gelatin is prepared. A suitable stirrer 2 is provided for continuously agitating and mixing the liquid contents of said vessel. A tank 3 contains silver salt e.g. silver nitrate dissolved in water, whereas tank 4 contains a halide salt e.g. potassium bromide, chloride, iodide or mixtures thereof dissolved in water. Said tanks 3 and 4 provided with discharge valves 5 and 6 are located at a level above a mixing device 7.

The mixing device 7 comprises three tubes 8, 9 and 10 constituting static mixers, each of the tubes defining a continuous flow mixing passageway. The tubes 8 and 9 define what has herein been referred to as separate mixing zones. Tube 10 defines what has herein been referred to as a reaction zone. The tubes 8, 9 and 10 may, depending on their design, contain stationary guide vanes or baffles as hereinbefore referred to.

Peptizer solution is pumped from vessel 1 along a discharge conduit 11 by a centrifugal pump 12 which forces the solution via conduits 13, 14 and 15 into mixers 9 and 8 through the nozzles of two venturi-type injectors 16 and 17.

Silver salt solution flows from tank 3 into the suction passage of the injector 16 via conduit 18 which is provided with a control valve 19 for controlling the flow rate. The flow of the salt solution takes place in part under gravity and in part under the venturi suction forces. At any given setting of the valve 19, the flow rate varies with variation in the suction forces. The tank 3 could be located at the same level as the injector 16 because the suction forces are strong enough to permit gravitational feed to be dispensed with.

Halide salt solution flows from tank 4 into the suction passage of the injector 17 via conduit 20, which is provided with a control valve 21 for controlling flow rate in the same way as valve 19.

The silver salt and peptizer solution entering static mixer 9 are thoroughly mixed therein. The halide salt and peptizer solution are likewise thoroughly mixed in mixer 8. The solutions discharging from these mixers enter directly into mixer 10 in which they are rapidly combined and thoroughly mixed to cause silver halide grains to form by reaction between the different salts. The silver halide emulsion discharging from mixer 10 is recycled to vessel 1 via conduit 22. This vessel is of larger volume in relation to the capacity of the remainder of the described circuit and physical ripening of the silver halide grains may take place therein. The pumping of emulsion through the venturi-type injectors and the recycling of emulsion to the vessel 1 continues until the emulsion contains a predetermined silver halide concentration, at which time the pump 12 is switched off.

The flow rates of the silver salt solution and the halide salt solution at a given suction force need not be the same. Likewise the molar concentrations of silver salt and halide salt in the respective solutions need not be the same. The relative flow rates (which can be adjusted by the valves 19 and 21) and the relative molar concentrations can be selected according to the emulsion properties required. Generally speaking it is preferable to work at the same flow rates and concentrations.

The volume ratio between the solution entering each venturi nozzle and the solution entering the suction side of the injector may, for example, be in the range 2:1 to 1000:1. In preferred methods the said ratio is between 20:1 and 40:1, e.g. about 30:1.

Figure 3:
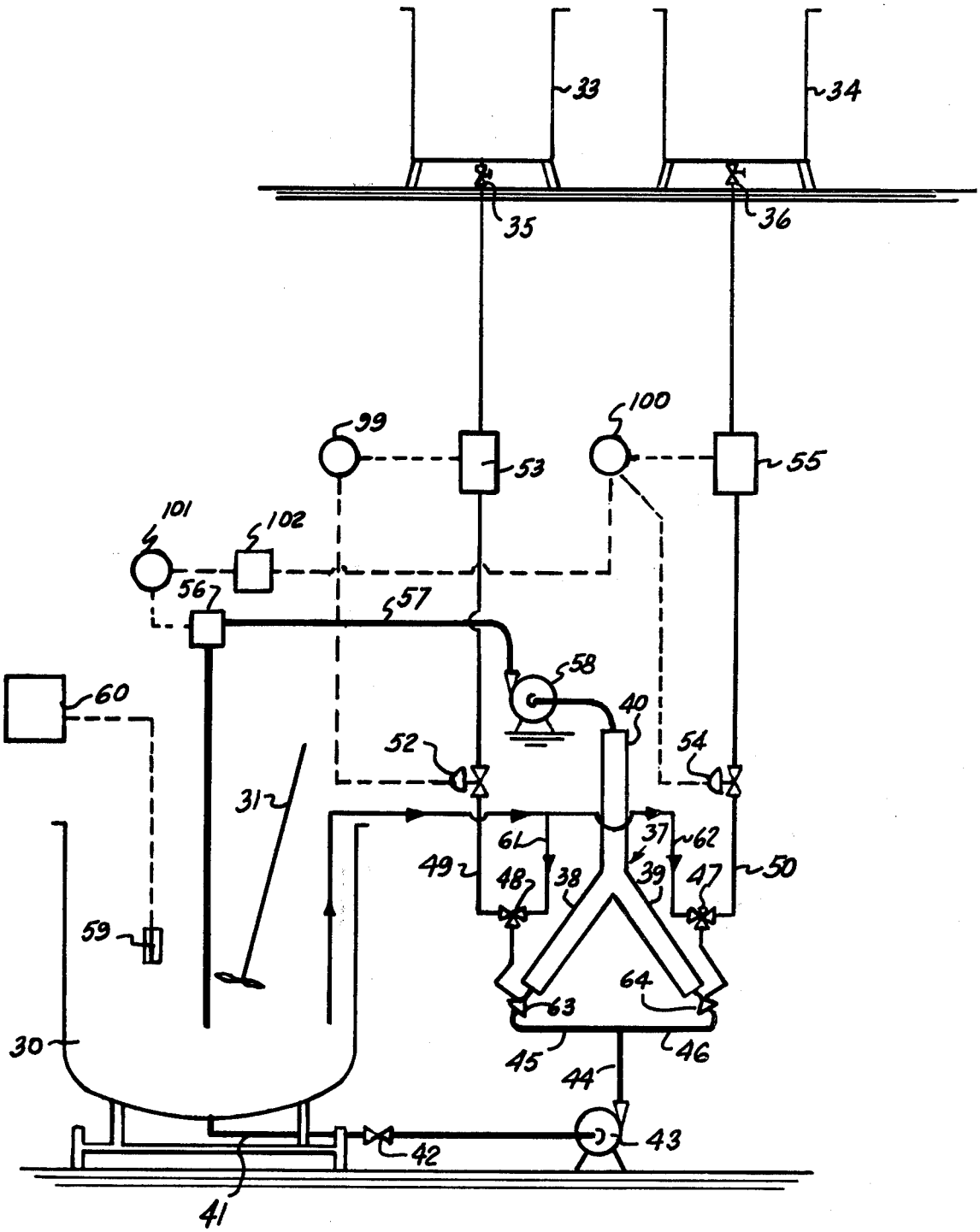
FIG. 3 represents another apparatus according to the invention.

The apparatus shown in FIG. 3, which is basically similar to that shown in FIG. 2, comprises a vessel 30 which initially contains prepared peptizer solution essentially composed of water and gelatin. A suitable stirrer 31 is provided for continuously agitating and mixing the contents of such vessel.

An aqueous silver salt, e.g. silver nitrate solution is held in tank 33 and an aqueous halide salt solution, e.g. a solution of potassium bromide, chloride or iodide, or a mixture thereof is held in tank 34. Salt solutions from these tanks discharge via valves 35, 36 to a mixing device 37 comprising static mixers 38, 39 and 40.

Peptizer solution, containing increasing amounts of silver halide grains in course of time, is pumped from vessel 30 along conduit 41 via valve 42 by centrifugal pump 43. This pump forces the material along conduits 44, 45 and 46 through the nozzles of venturi-type injectors 63, 64. Silver salt solution from tank 33 enters a three-way junction 48 via conduit 49 and is mixed in that junction with a secondary stream of peptizer solution (likewise containing increasing amounts of silver halide in course of time) which flows to that junction from vessel 30 via conduit 61. Both the flow of material through junction 48 from conduit 49, and the flow of material through that junction from conduit 61, take place under the influence of and at a volume rate which is dependent on the suction force exerted by the injector 63.

The halide salt solution flowing to the suction side of injector 64 is similarly mixed with a stream of material withdrawn from vessel 30. The streams of material to be mixed enter a three-way junction 47 from conduits 50 and 62.

The volume mixing ratio between the salt solution from tank 33 or 34 and emulsion drawn from vessel 30, in each of the junctions 48 and 47 may for example be in the range 1:1 to 1:100.

The silver halide emulsion discharging from the static mixer 40 defining the reaction zone is pumped back into vessel 30 along conduit 57 by a centrifugal pump 58. However this pump could be dispensed with and pump 43 alone relied upon for effecting the circulation of material through the circuit comprising vessel 30 and mixing device 37.

The flow rate of the silver salt solution from tank 33 towards injector 63 is influenced by a valve 52 which is automatically controlled by a controller 99 responsive to output signals from a magnetic flow meter 53. The controller 99 serves during the starting procedure and under load conditions during the progress of the method to operate valve 52 in a manner which tends to keep the flow rate as near as possible to a pre-set value.

The flow rate of the halide salt solution from tank 34 towards injector 64 is influenced by a valve 54 which is automatically controlled by a controller 100 responsive to output signals from a magnetic flow meter 55 and from a controller 101 which is itself responsive to output signals from a pAg sensing device 56. The location of the sensing device 56 in the conduit which receives the emulsion directly from the reaction zone defined by mixer 40 favours a rapid response of the flow control system to fluctuations in pAg.

A pAg sensing device 59 is immersed in the liquid in vessel 30 and is connected to a pAg versus time recorder 60.

When measuring pAg, a logarithmic value is obtained. The corresponding output signal from the sensing device 56, being a logarithmic value, is converted electronically in the convertor 102 into the corresponding antilog signal and it is this antilog signal which is fed to the controller 100 for influencing the control valve 54.

The vessel 30 and the various conduits and mixers may be thermally insulated. The liquid in vessel 30 may be cooled or heated and/or maintained at constant temperature by suitable temperature control means.

Special precautions are taken during a preparatory procedure to stabilize the pAg if heavy demands are imposed on the pAg stability at this time. The special measures ensure that the silver salt and halide salt solutions will enter the mixers at appropriate relative flow rates at the start of the preparation of the emulsion batch. For example steps are taken to ensure that even at the commencement of the preparation, silver halide grain formation takes place near the equivalence point.

In one very suitable preparatory procedure, the appropriate flow rates of the different salt solutions are achieved by causing these solutions to flow via the different flow rate meters above described into by-pass conduits leading to separate vessels under reduced pressure. Once the correct flow rate is obtained, the streams of salt solutions are switched to the venturi-time injectors. The reduced pressure in the said separate vessels is tuned in on the reduced pressure (suction pressure) created by the flow of peptizer solution from vessel 30 through the injector nozzles. In order to avoid marked change in the pressure in the injectors consequent upon the switching of the streams of salt solution to the injectors, the volume flow rate of peptizer solution from vessel 30 into the conduit junctions 47 and 48 is preferably a high multiple of the flow rate of such streams of salt solutions into such junctions. In that way any small pressure oscillations are kept very small.

Figure 4:
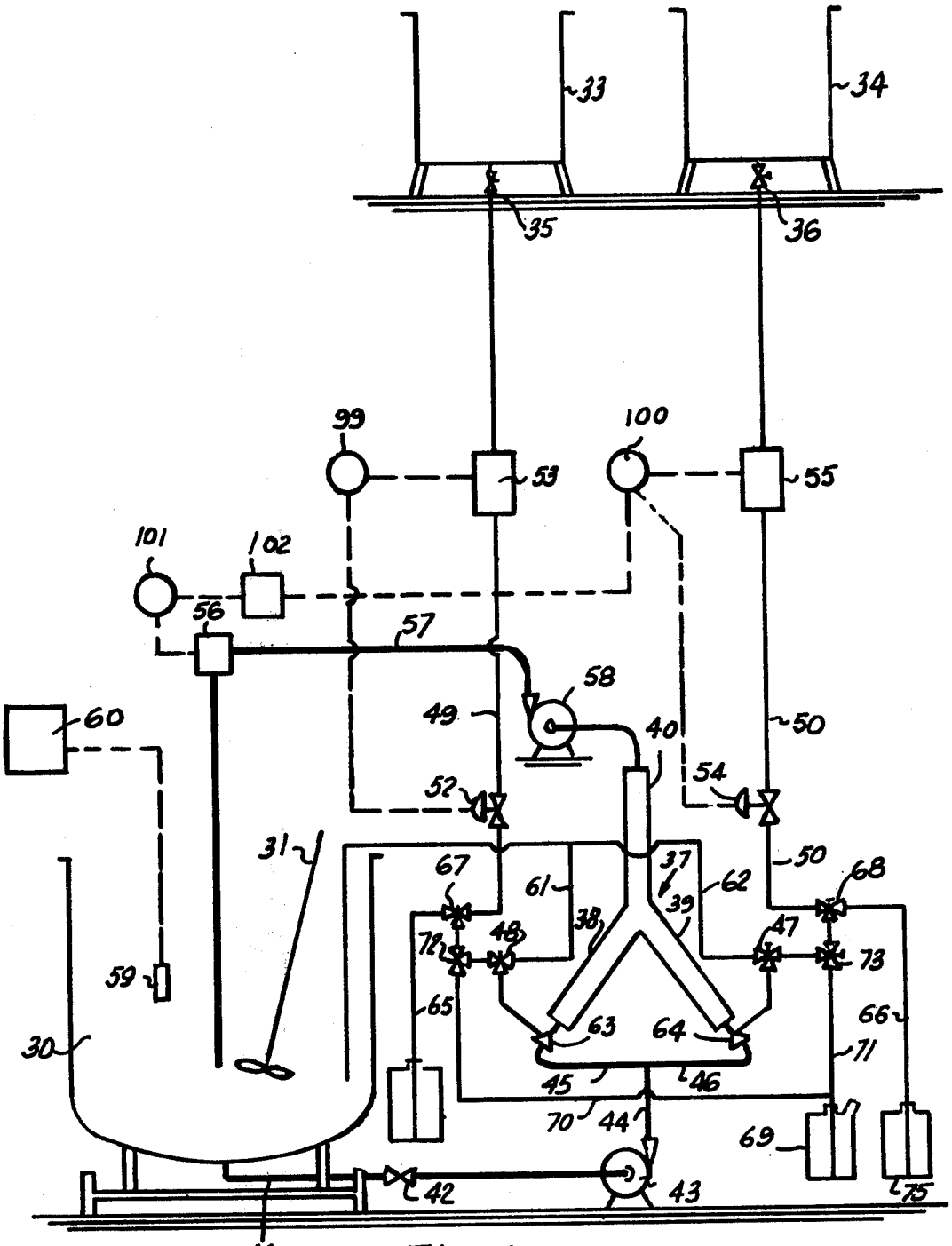
FIG. 4 represents an apparatus as represented in FIG. 3 but having means for carrying out a preparatory procedure for setting the flow rates of reactant salt solutions.

To enable such preparatory procedure to be carried out the apparatus shown in FIG. 3 can be modified as represented in FIG. 4. Only the additional apparatus components appearing in this figure will be described.

The additional components include vessels 74 and 75 in which a reduced pressure can be maintained by means which is not shown, while they are receiving silver salt solution and halide salt solution respectively. The vessels 74 and 75 are connected by by-pass conduits 65 and 66 to three-way valves 67 and 68. A de-aeration vessel 69 connected to conduits 70 and 71 serves as means for de-aerating the conduits 49 and 50.

Three-way valves 72 and 73 allow the de-aeration vessel 69 to be connected to and disconnected from the conduits 49 and 50 and the respective streams of salt solution to be switched into the respective venturi-type injectors 63 and 64.

In a preferred venturi-type pump for use in the present invention the suction entrance lies within the projected length of the nozzle. For adjusting the suction flow rate the suction tube is preferably made movable enabling an axial displacement of the tube in a direction crossing the axis of the nozzle.

Figure 5:
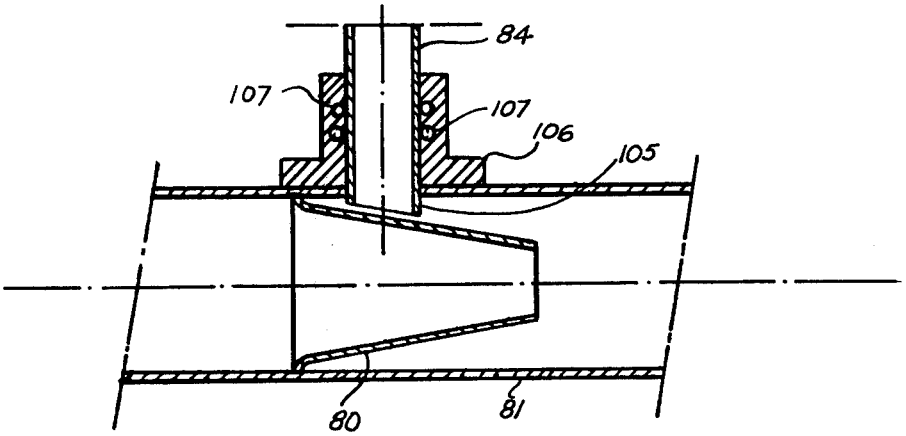
FIG. 5 is a cross-sectional view of a venturi-type injector pump used in apparatus according to the invention.

A venturi-type injector is illustrated in FIG. 5. The actual construction chosen for this illustration is merely by way of an example. The injector comprises a nozzle 80 which is secured in conduit 81, and a suction tube 84. The position of the outlet end 105 of this suction tube with respect to the nozzle 80 is adjustable for varying the suction force (venturi effect) which is established in the tube 84 in operation of the injector. This adjustment involves axial displacement of the tube 84 in a gland 106 which is fitted to the conduit 81. The tube 84 is sealed in this gland by means of two O-rings 107. Means (not shown) may be provided for enabling the tube 84 to be accurately adjusted and for locking the tube in any adjusted position.

As already indicated herein, the static mixers used in the illustrated apparatus can be any of various constructions. And the length of these mixers, i.e. the length of the continuous flow mixing passageways, can be selected according to the desired mixing results. Any or all of the mixers may be of a type having internal guide vanes or baffles for promoting the mixing action and the mixers can be operated under laminar or turbulent flow conditions provided that the mixing action is sufficient having regard to the viscosity of the liquids.

Figure 6:
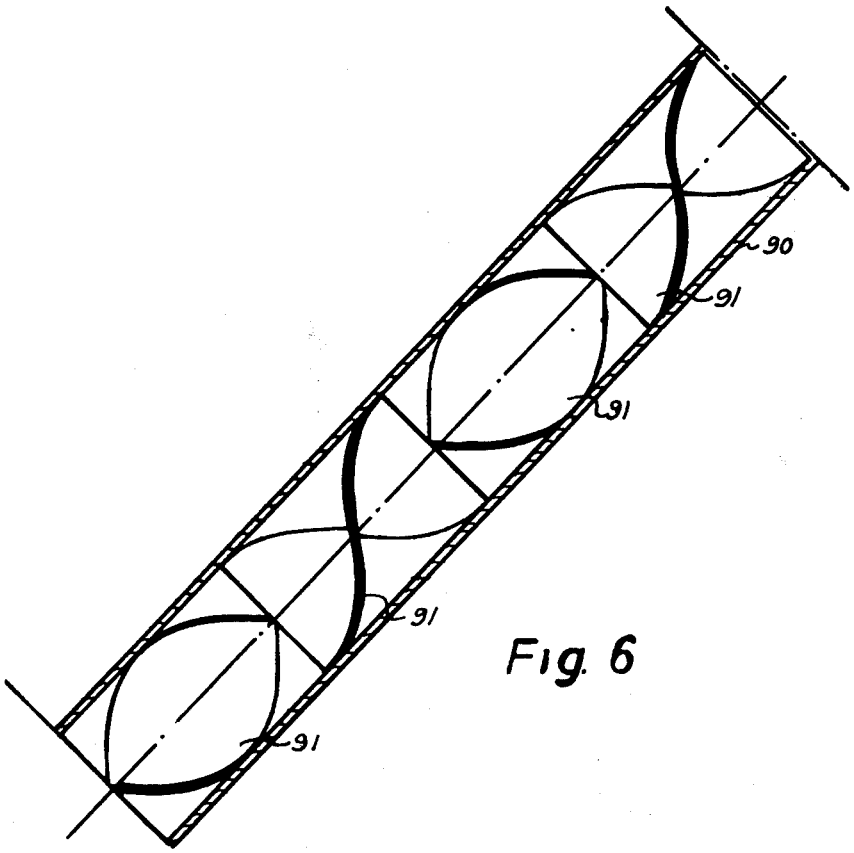
FIG. 6 is a cross-sectional view of one form of static mixer providing a continuous flow mixing passageway.

FIG. 6 is a cross-section of a static mixer with internal stationary elements. The mixer comprises a tube 90 which over the whole or a part of its length has internally thereof a plurality of twisted elements 91 arranged in series along the tube. Static mixers of this kind can be used in apparatus as described with reference to FIGS. 2 to 4.

We claim:

1. A method for the preparation of a photosensitive silver halide emulsion wherein separate streams of circulating peptizer solution are circulated with at least one power operated pump through separate mixing zones in which one is mixed with a solution of a silver salt and the other is mixed with a solution of a halide salt, and said streams are then combined and mixed in a reaction zone so that silver halide crystals are formed by reaction between silver salt and halide salt and the circulating peptizer solution contains increasing amounts of silver halide crystals in course of time, said circulation being continued until a silver halide emulsion of a predetermined concentration has been formed, characterised in that each of said separate streams of peptizer solution is formed into its corresponding separate mixing zone and thence into said reaction zone through the nozzle of a venturi-type pump and a stream of each of the silver salt solution and the halide salt solution is fed into the corresponding separate mixing zone under the influence of and at a flow rate dependent on the venturi suction effect of the corresponding venturi-type pump, said venturi pumps being operated under such conditions as to damp high frequency (above 1 Hz) pAg oscillations attributable to the inherent characteristics of each such pump used for circulating the peptizer solutions, the flow rate of each venturi pump being sufficient in relation to the operating pressure thereof that the flow is substantially independent of said pressure.

2. A method according to claim 1, characterized in that each of the streams of silver salt solution and halide salt solution, before entering its corresponding separate mixing zone, is pre-diluted with a secondary stream of circulating peptizer solution also delivered under the influence of and at a rate dependent on the venturi suction effect.

3. A method according to claim 2, characterized in that the volume mixing ratio between each salt solution stream and the corresponding secondary stream of peptizer solution is in the range 1:1 to 1:100.

4. A method according to claim 1, characterized in that the volume mixing ratio between the peptizer stream discharging from each venturi nozzle and the salt solution drawn into the pump under the influence of the venturi suction effect is in the range 2:1 to 1000:1.

5. A method according to claim 1, characterized in that the volume mixing ratio between the peptizer solution delivered through the nozzle of each venturi-type pump and the salt solution drawn into such pump under the influence of the venturi suction effect is regulated during the progress of the reaction by valve means which is controlled automatically in response to variations in the pAg of the recycled silver halide emulsion.

6. A method according to claim 1, characterized in that the circulating peptizer solution is maintained in circulation by at least one centrifugal pumps.

7. A method according to claim 1, characterized in that the said separate mixing zones and said reaction zone are formed by continuous-flow mixing passageways in which mixing occurs under the kinetic energy of the liquid streams flowing therethrough.

8. A method according to claim 1, characterized in that the reaction between silver salt and halide salt in the reaction zone takes place near the equivalence point.

9. A method according to claim 1, characterized in that silver halide emulsion discharging from the reaction zone is delivered into a receiving vessel of larger capacity than said reaction zone and silver halide emulsion is recycled from said vessel to form said separate streams of peptizer solution which are forced through the nozzles of the venturi-type pumps.

10. A method according to claim 1, characterized in that as a preparatory step, discharge flows of silver salt solution and halide salt solution from supply vessels are established and the relationship of the volume rates of such discharge flows is adjusted to a predetermined value appropriate to the silver halide formation conditions required and such adjusted discharge flows are then switched to the venture-type pumps.

11. A method according to claim 10, characterized in that said preparatory discharge flows of salt solutions take place into receiving vessels while the interiors thereof are at reduced pressure.

* * * * *